US011258235B2

(12) United States Patent
Below et al.

(10) Patent No.: US 11,258,235 B2
(45) Date of Patent: Feb. 22, 2022

(54) HIGH THREAD JAMB NUT WITH RETAINING CLIP

(71) Applicant: FRAM GROUP IP LLC, Cleveland, OH (US)

(72) Inventors: Matthew B Below, Findlay, OH (US); Timothy J Smith, Bettsville, OH (US)

(73) Assignee: FRAM GROUP IP LLC, Cleveland, OH (US)

( * ) Notice: Subject to any disclaimer, the term of this patent is extended or adjusted under 35 U.S.C. 154(b) by 0 days.

(21) Appl. No.: 17/063,081

(22) Filed: Oct. 5, 2020

(65) Prior Publication Data

US 2021/0104874 A1 Apr. 8, 2021

Related U.S. Application Data

(60) Provisional application No. 62/910,756, filed on Oct. 4, 2019.

(51) Int. Cl.
*H01T 13/12* (2006.01)
*H01T 13/08* (2006.01)
*H01T 13/36* (2006.01)

(52) U.S. Cl.
CPC ..... *H01T 13/08* (2013.01); *H01T 13/12* (2013.01); *H01T 13/36* (2013.01)

(58) Field of Classification Search
CPC ..... H01T 13/08; H01T 13/12
USPC ..... 174/152 S
See application file for complete search history.

(56) References Cited

U.S. PATENT DOCUMENTS 5,697,334 A * 12/1997 Below ..... H01T 13/08 123/169 R
5,918,571 A * 7/1999 Below ..... H01T 13/467 123/169 R
6,104,130 A * 8/2000 Below ..... H01T 13/08 123/169 EL (Continued)

*Primary Examiner* — Christopher M Raabe
(74) *Attorney, Agent, or Firm* — Bryan Cave Leighton Paisner LLP

(57) ABSTRACT

A spark plug is provided that includes an improved jamb nut configuration, which provides improved torque transfer and prevents inadvertent separation of the jamb nut from the remaining components of the spark plug, particularly during removal from the engine head. The spark plug is configured for axial insertion into the plug hole, and may have a non-axisymmetric ground shield that fits into the plug hole, wherein the plug hole is also provided with a complementary non-axisymmetric shape. The spark plug includes a central insulator, which has an inner end surrounding a central electrode and supporting the ground shield, which is mounted on the insulator to support a ground strap adjacent the electrode for forming a spark therebetween. The insulator and ground shield are axially slidable into the plug hole, and the jamb nut is rotatable to fix the spark plug in position in a predefined orientation. The insulator includes a retaining clip outwardly of the jamb nut that permits rotation of the jamb nut relative to the insulator but prevents axial separation of the jamb nut during removal of the spark plug from the engine head. An improved tool is also provided which better distributes torque transfer to the jamb nut and includes a catch to facilitate pulling of the spark plug from the engine head.

20 Claims, 13 Drawing Sheets

(56) References Cited

U.S. PATENT DOCUMENTS

| | | | | |
|---|---|---|---|---|
| 8,030,831 | B1 * | 10/2011 | Below | H01T 13/20 313/141 |
| 10,938,185 | B1 * | 3/2021 | Matulich | H01T 13/32 |
| 2009/0189503 | A1 * | 7/2009 | Below | H01T 13/32 313/141 |
| 2012/0112621 | A1 * | 5/2012 | Below | H01T 13/41 313/141 |
| 2018/0294624 | A1 * | 10/2018 | Niessner | H01T 13/08 |
| 2021/0104875 | A1 * | 4/2021 | Below | H01T 13/08 |

* cited by examiner

HIGH THREAD JAMB NUT WITH RETAINING CLIP

CROSS-REFERENCE TO RELATED APPLICATIONS

This application claims priority to U.S. Provisional Application No. 62/910,756, filed on Oct. 4, 2019, which is hereby incorporated by reference in its entirety.

FIELD OF THE INVENTION

The invention relates to a high thread spark plug, and more particularly, to a spark plug that has a jamb nut restrained axially on an insulator by a retaining clip to facilitate spark plug removal.

BACKGROUND OF THE INVENTION

Spark plugs are conventionally mounted in an engine head of an internal combustion engine and protrude into a combustion chamber to ignite fuel during engine operation. To optimize the performance of such engines, it may be desirable to define a precise location and orientation for the spark plug in the combustion chamber. Once mounted in the engine head, long term operation of the spark plug may increase the difficulty in removing the spark plug from the plug hole in the engine head.

In one known example of a spark plug, U.S. Pat. No. 5,091,672 discloses a spark plug for use in an internal combustion engine having an insulator that surrounds a center electrode. The insulator includes a sleeve that surrounds the insulator and defines an integral ground electrode on the end thereof. The spark plug further includes a castle head jamb nut for sealing the spark plug in the spark plug hole. However, one disadvantage with this design is that during removal of the spark plug, the jamb nut might separate and back out from the plug hole while leaving the remainder of the spark plug stuck therein.

In some spark plug designs, a jamb nut may be fixed to the insulator. However, the connection therebetween may only be able to handle a relatively low amount of torque such that damage may occur during multiple installs and removals from the engine head.

Notwithstanding the existence of these spark plug designs in the prior art, it is an object of the invention to provide an improved spark plug having an improved jamb nut configuration which overcomes disadvantages with prior art plug designs.

SUMMARY OF THE INVENTION

The present invention relates to a spark plug that overcomes disadvantages associated with the prior art wherein the inventive spark plug is configured with an improved jamb nut restrained axially by a retaining clip. The inventive spark plug includes an improved jamb nut, which provides improved torque transfer and prevents inadvertent separation of the jamb nut from the remaining components of the spark plug, particularly during removal from the engine head.

The spark plug includes a central insulator, which has an inner end surrounding a central electrode and supporting the ground shield, which is mounted on the insulator to support a ground strap adjacent the electrode for forming a spark therebetween. The spark plug may be configured for axial insertion into the plug hole, and may have a non-axisymmetric ground shield that fits axially into the plug hole, wherein the plug hole is also provided with a complementary non-axisymmetric shape that prevents rotation of the spark plug therein and limits the spark plug to a predefined orientation. While the insulator and ground shield are axially slidable into the plug hole, the jamb nut is rotatable to fix the spark plug in position in the predefined orientation.

The insulator includes a retaining clip outwardly of the jamb nut that permits rotation of the jamb nut relative to the insulator but prevents axial separation of the jamb nut during removal of the spark plug from the engine head. An improved tool is also provided which better distributes torque transfer to the jamb nut and includes a catch to facilitate pulling of the spark plug from the engine head. This inventive arrangement provides for an improved spark plug having the jamb nut held axially on the insulator by the retaining clip to prevent the jamb nut from backing out and separating from the remaining plug components during removal. Further, the jamb nut distributes torque from the tool over an increased surface area during installation and removal, and includes a catch so that the tool is usable to help remove the spark plug from the plug hole.

Other objects and purposes of the invention, and variations thereof, will be apparent upon reading the following specification and inspecting the accompanying drawings.

Figure 1:
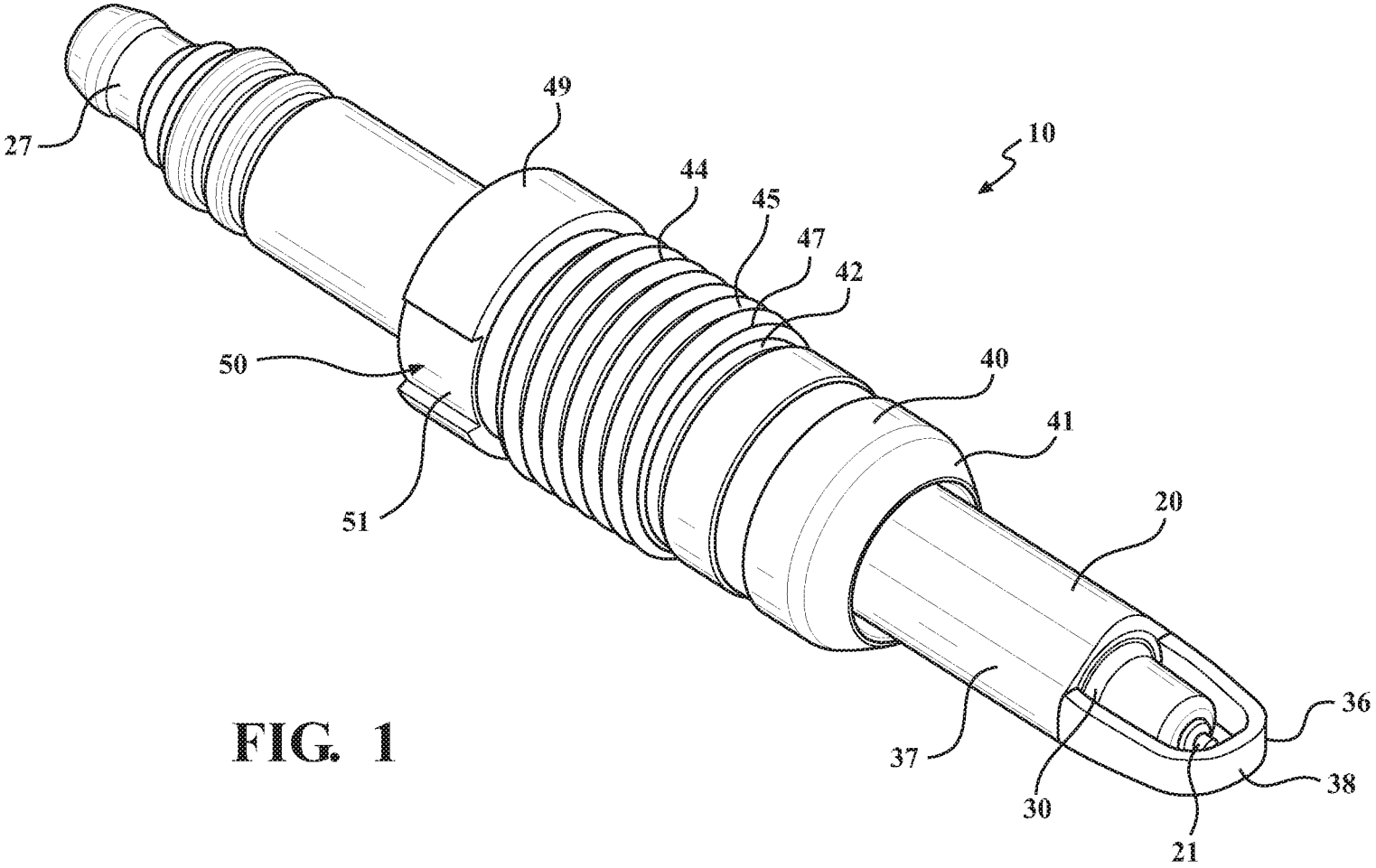
FIG. 1 is a perspective view of a spark plug in accordance with a first embodiment of the present invention as viewed from a first orientation of the spark plug.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION OF THE EMBODIMENTS

Figure 2:
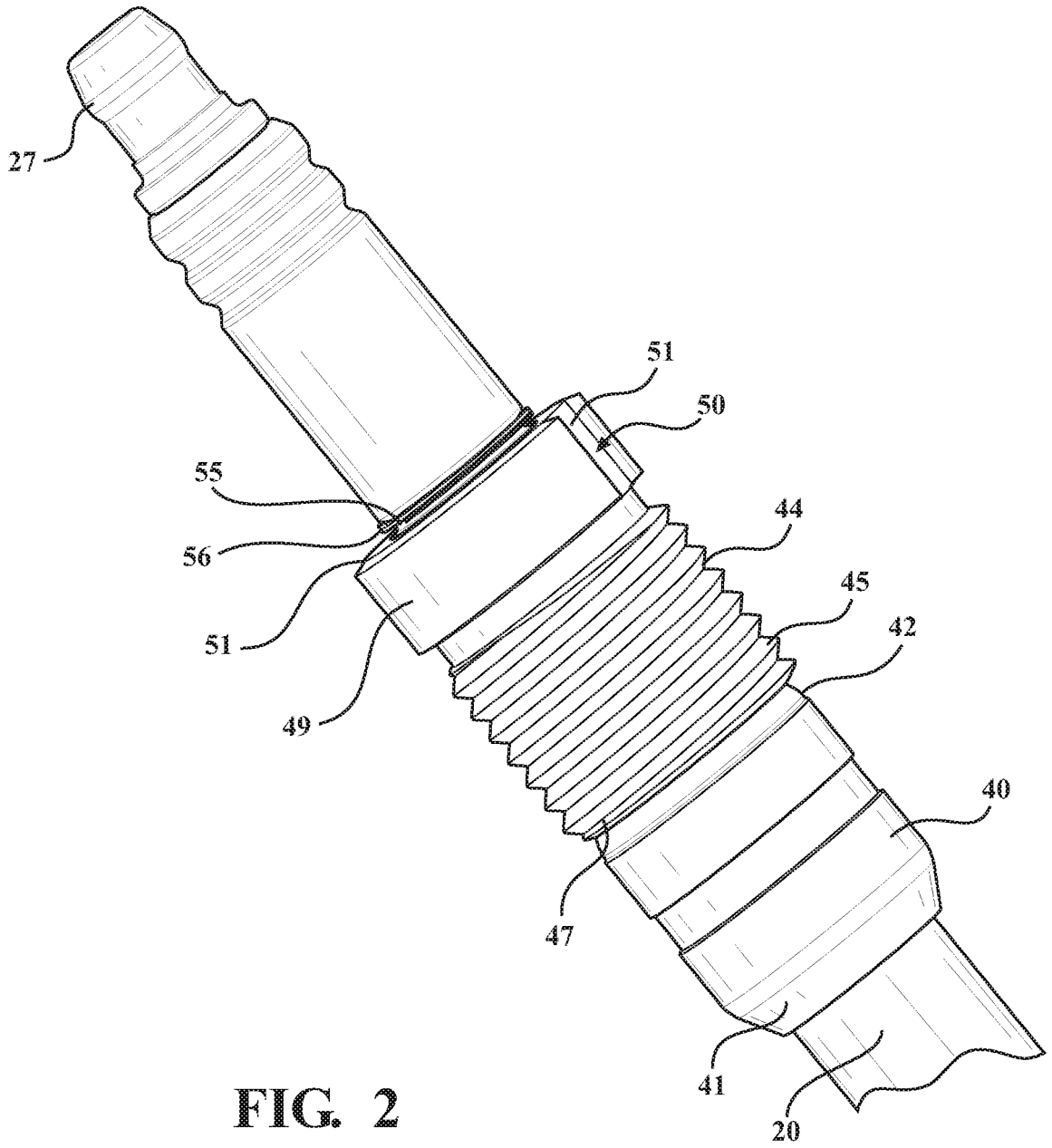
FIG. 2 is a further perspective view of the spark plug of FIG. 1 as viewed from a second orientation of the spark plug.
Figure 3:
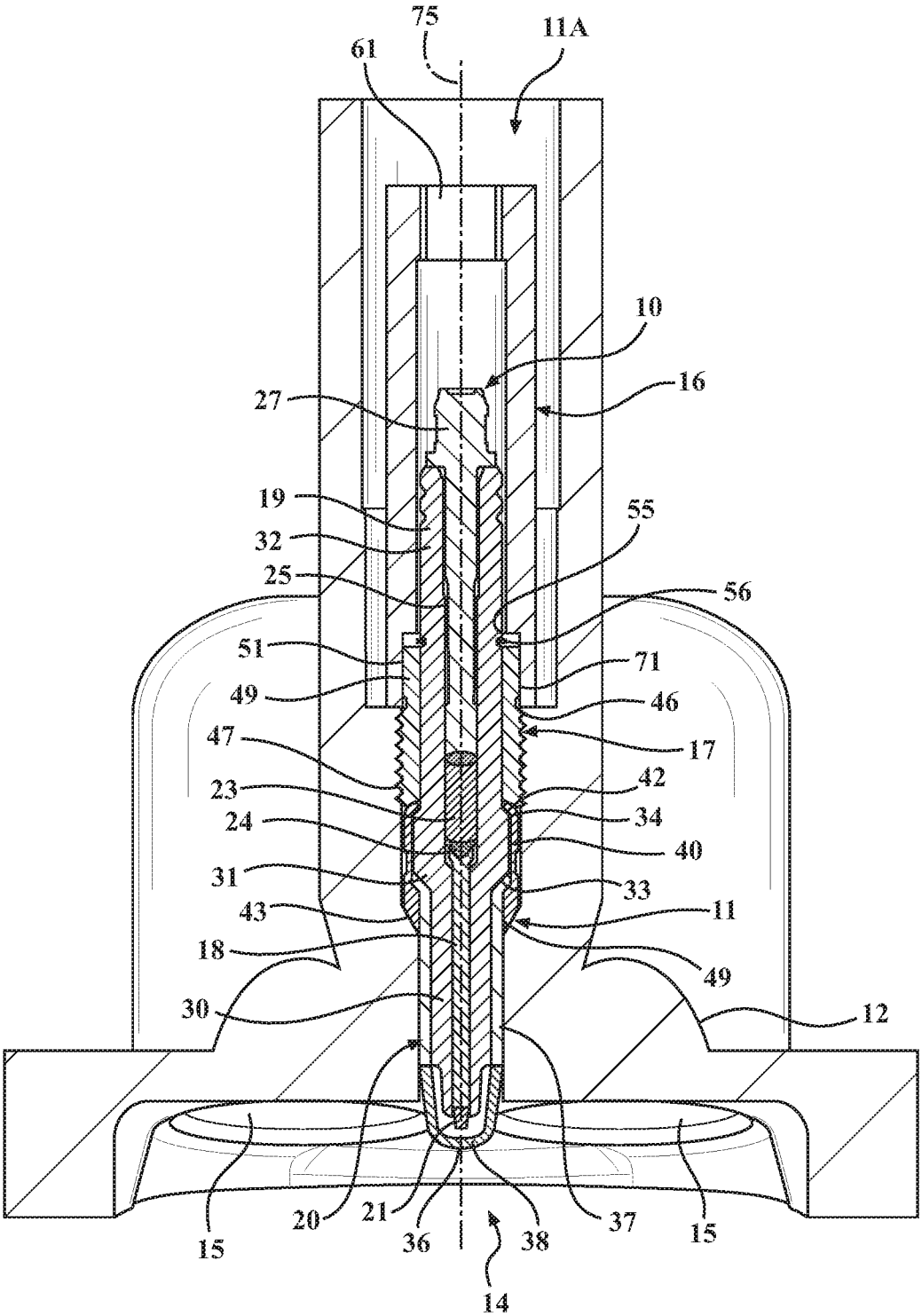
FIG. 3 is a cross sectional view of the spark plug mounted in a plug hole provided in an engine head.

FIGS. 1-3 illustrate an exemplary embodiment of a high-thread spark plug 10 in accordance with the present invention. The spark plug 10 is designed for use in internal combustion engines.

As seen in FIG. 3, the spark plug 10 is removably installed in an internal combustion engine by threaded engagement of the spark plug 10 within a plug bore or hole 11 as typically formed in the engine head 12. As such, the spark plug 10 may protrude into a combustion chamber 14 although in some applications, the spark plug 10 may be recessed in the plug hole while still generating spark to ignite fuel. The engine head 12 is formed with a plurality of intake and exhaust passages 15 opening into the combustion chamber 14 and located generally proximate to the spark plug 10 in any conventional configuration. The spark plug 10 is installed using a tool, preferably formed as a socket 16 which engages with a jamb nut 17 on the spark plug 10 so that the spark plug 10 may be manually rotated or screwed into and out of engagement with the engine head 12. In a first aspect, the present invention relates to an improved jamb nut configuration, which provides improved torque transfer and prevents inadvertent separation of the jamb nut 17 from the remaining components of the spark plug 10 during removal from the engine head 12.

In more detail as to the spark plug 10 shown in FIGS. 1-3, the spark plug 10 includes a cylindrical center electrode assembly extending along the axial length of the spark plug 10, which comprises a center electrode 18 at one end of the spark plug 10. The spark plug 10 further includes a ceramic or similarly comprised insulator 19 that concentrically surrounds the electrode assembly including the center electrode 18, and a generally shell-shaped ground shield 20 that surrounds at least a portion of the insulator 19 at one end.

In the illustrated embodiment, the center electrode 18 has a cylindrical body with an exposed tip 21 at one exterior end, which is secured concentrically within insulator 19 to be electrically isolated from the ground shield 20. The other interior end of center electrode 18 is located opposite to the tip 21 and is electrically connected to an end of a resistive element 23 through a glass seal 24 that comprises an electrically conductive material. The other end of the resistive element 23 is electrically connected through the glass seal 24 to an adjoining end of a cylindrical terminal stud 25. Glass seal 24 serves as the electrical connection between the terminal stud 25 and center electrode 18. Terminal stud 25, in turn, includes an exposed terminal nut 27. The terminal nut 27 is configured to attach to an ignition cable (not shown) of the engine, which said ignition cable supplies the electric current to the spark plug 10 when the spark plug 10 is installed in the engine head 12 so as to generate sparks within the combustion chamber 14 during engine operation.

As known in the art, the center electrode 18 may be formed in different configurations comprising conductive materials such as copper or other suitable metals or metal alloys, and the terminal stud 25 can comprise steel or a steel-based alloy material with a nickel-plated finish or other suitable materials.

In the present exemplary embodiment as seen in FIG. 3, insulator 19 has an elongated, substantially cylindrical body with first 30, second 31, and third 32 insulator sections having different diameters. First insulator section 30 substantially surrounds center electrode 18. Second insulator section 31 is located intermediate the first and third insulator sections 30 and 32 and the diameter of the second insulator section 31 is greater than the respective diameters of either of the other two insulator sections 30 and 32. The second insulator section 31 and the narrower first insulator section 30 are separated by a radial shoulder 33, and the second insulator section and narrower third insulator section 32 are separated by a radial shoulder 34. In exemplary embodiments, insulator 19 can comprise a non-conducting ceramic material such as, for example, alumina ceramic so that it may fixedly retain center electrode 18 while preventing an electrical short between the center electrode 18 and ground shield 20.

Ground shield 20, which surrounds first insulator section 30, includes a frustoconical section at one end that is juxtaposed with insulator shoulder 33, a generally U-shaped ground electrode strap 36 that extends from and diametrically spans the ground shield 20 near the opposite end, and a generally annular base portion or wall 37 axially extending between the frustoconical section and the ground electrode strap 36. The base portion 37 includes a cylindrical interior surface that concentrically surrounds the first insulator section 30. The ground electrode strap 36 includes a free end 38 that faces and is axially spaced from the electrode tip 21 to form a spark gap therebetween. The electrode tip 21 and the free end of the electrode strap 36 define the opposed sparking surfaces of the spark plug 10 when the spark plug 10 is energized to form sparks therebetween and thereby ignite fuel within the combustion chamber 14 during engine operation.

The spark plug 10 further includes a cylindrical shell 40, which concentrically surrounds the second insulator section 31. The shell 40 has opposite ends which define radial flanges or shoulders 41 and 42 which are frustoconical wherein interior surfaces of the radial flanges 41 and 42 abut tightly against the respective insulator shoulders 33 and 34 of the second insulator section 31 so that the shell 40 is fixed axially in position on the exterior of the second insulator section 31. Further, an exterior surface of the lowermost radial flange 41 is configured to abut against a corresponding bore shoulder 43 formed in the plug hole 11 (FIG. 3) when the spark plug 10 is fully seated therein. The bore shoulder 43 similarly has a frustoconical shape, which defines a seated position for the spark plug 10 within the plug hole 11, which seals out combustion gases by the tight abutting contact between the radial flange 41 and bore shoulder 43. Further, the upper flange 42 generally faces upwardly out of the plug hole 11 for driving engagement with the jamb nut 17 as described in more detail below.

Referring again to FIGS. 1-3, the jamb nut 17 generally serves as an annular retainer for retaining the spark plug 10 in the plug hole 11. The lower end of the jamb nut 17 has a threaded portion 44, which is cylindrical and surrounds a lower portion of the third insulator section 32 that is located axially adjacent to the second insulator section 31 and the radial shoulder 34 thereof. The threaded portion 44 is externally-threaded to define external threads 45 that threadedly engage with internal threads 46 formed in the open upper end portion of the plug hole 11. As such, the spark plug 10 may be screwed into and out of the plug hole 11. The lower end of the threaded portion 44 terminates at an annular drive rim 47, wherein the diameter of the threaded portion 44 and drive rim 47 are generally similar to the outer diameter of the shell 40 so that the drive rim 47 can axially contact and drivingly abut against the upper flange 42 of the shell 40. Screwing of the jamb nut 17 into the plug hole 11 moves the spark plug 10 axially since the drive rim 47 contacts and drives the shell 40 and associated insulator 19 axially into the plug hole 11.

To facilitate rotation of the jamb nut 17, the jamb nut 17 has an upper end formed as a drive collar or drive section 49. The drive collar 49 has a generally annular shape that projects radially outwardly of the threaded portion 44 to essentially form a nut-like drive formation at one end that surrounds a portion of third insulator section 32. The third insulator section 32 protrudes from beyond the jamb nut 17 so that the terminal nut 27 is accessible within an upper bore chamber 11A for connection to the spark plug wire. In the exemplary embodiment, the jamb nut 17 can comprise a conductive metal material such as a nickel-plated, low-carbon steel-based alloy.

Figure 4:
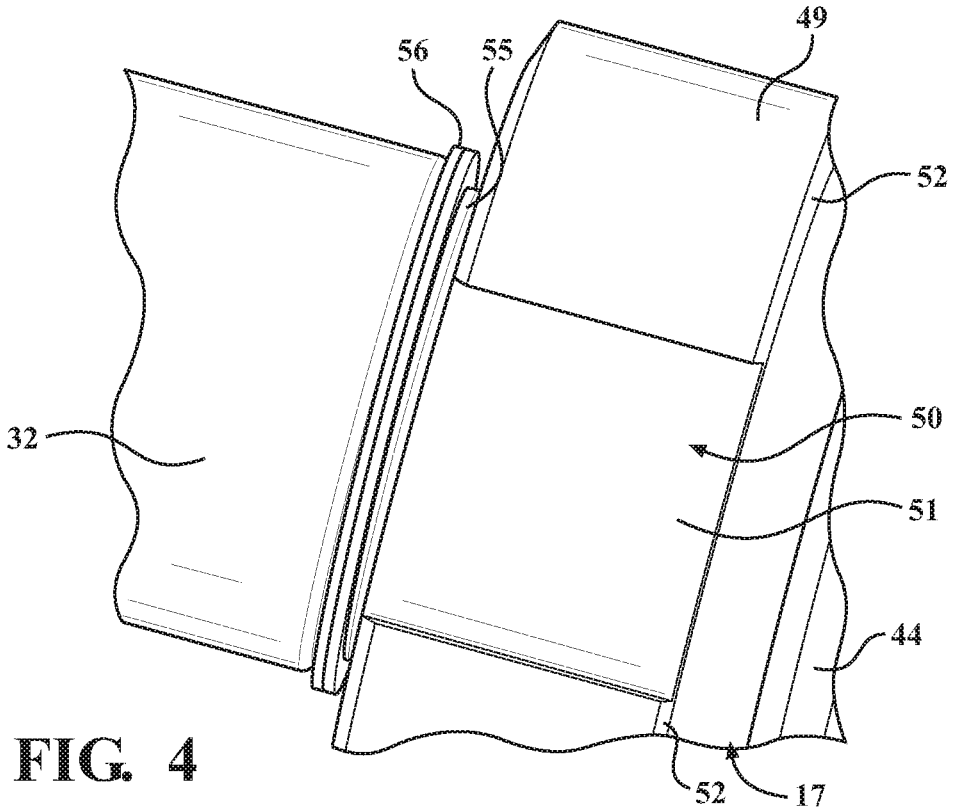
FIG. 4 is an enlarged partial perspective view of the spark plug with a jamb nut and retaining clip for the jamb nut.
Figure 5:
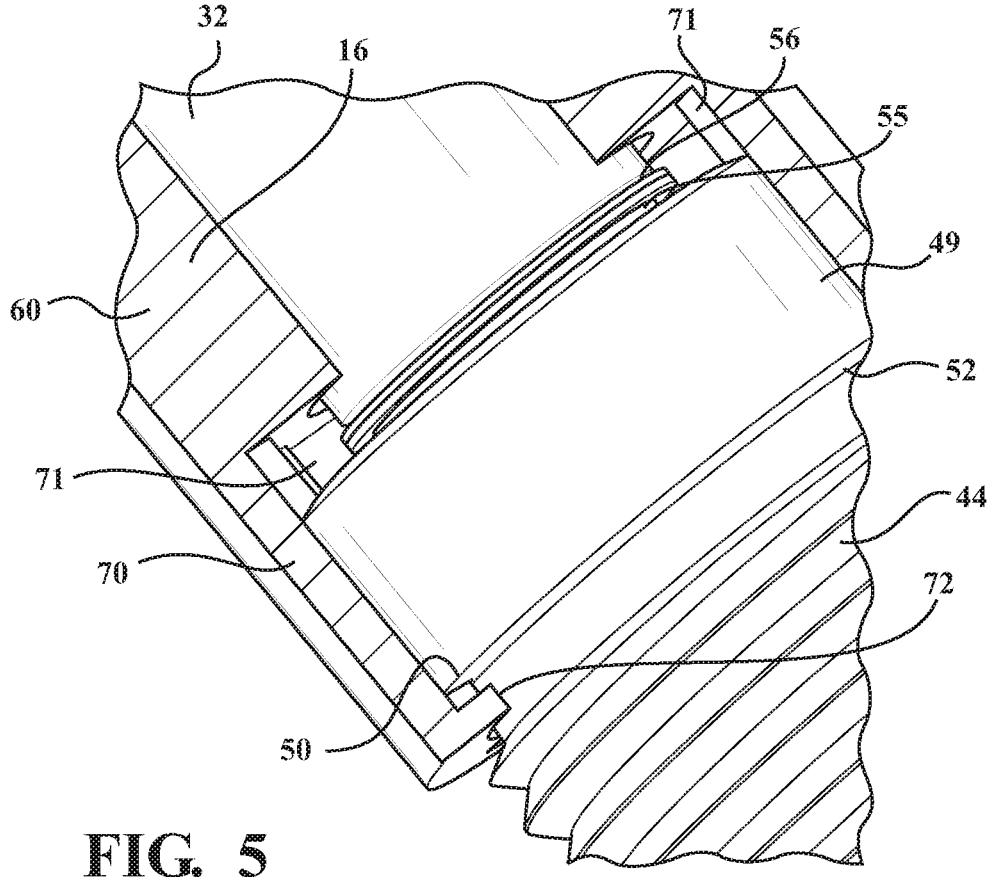
FIG. 5 is a partial perspective view of a drive socket engaged with the jamb nut for screwing and unscrewing the spark plug in the engine head.

As shown in more detail in FIGS. 4 and 5, the drive collar 49 defines one or more drive formations 50 preferably formed as axial slots 51 that extend through the axial length of the drive collar 49 and open axially from their opposite slot ends. Preferably, the drive formations 50 comprise two slots 51 located on diametrically opposite sides of the drive collar 49 although different quantities and geometries of drive slots 51 may be provided.

The drive collar 49 forms an annular shoulder 52, which extends circumferentially between the lower slot ends of the slots 51. As such, the collar shoulder 52 comprises arcuate shoulder sections that each extend between a pair of slots 51, or in other words, each slot 51 is disposed between two shoulder sections. As described further below, the collar shoulder 52 facilitates removal of the spark plug 10 by the socket 16.

To restrain the jamb nut 17 axially relative to the insulator 19, the third insulator section 32 includes an annular connector 55 preferably formed as a connector slot or groove, which is located axially above the drive collar 49. The connector slot 55 seats an annular retainer or retaining clip 56, which projects radially outwardly from the third insulator section 32 to axially interfere or abut against the drive collar 49. The retaining clip 56 is axially fixed within the connector slot 55. As such, the jamb nut 17 is restrained axially between the retaining clip 56 and the shoulder 42 of the shell 40, which fixes the jamb nut 17 axially on the insulator 19 while permitting the jamb nut 17 to rotate relative to the remaining spark plug components including the insulator 19 and shell 40.

With the above-described configuration, the threaded portion 44 is configured to threadedly engage the threaded portion 47 of the plug hole 11, wherein the drive collar 49 can be engaged with and rotated by a suitable tool such as the socket 16 referenced above. The jamb nut 17 preferably is rotatable relative to the insulator 19 and shell 40 so that rotation of the jamb nut 17 can drive the spark plug 10 into the plug hole 11 until the lower flange 41 of the shell 40 abuts axially against the corresponding bore shoulder 43, at which time the spark plug 10 is tightly seated within the plug hole 11.

The jamb nut 17 may also be rotated in the opposite direction to allow the spark plug 10 to be removed or unscrewed from the plug hole 11. During spark plug removal, the jamb nut 17 is restrained axially by the retaining clip 56 so that axial movement of the threaded portion 44 causes the drive collar 49 to axially contact the retaining clip 56 and ensure that the spark plug 10 is displaced axially out of the plug hole 11.

Figure 6:
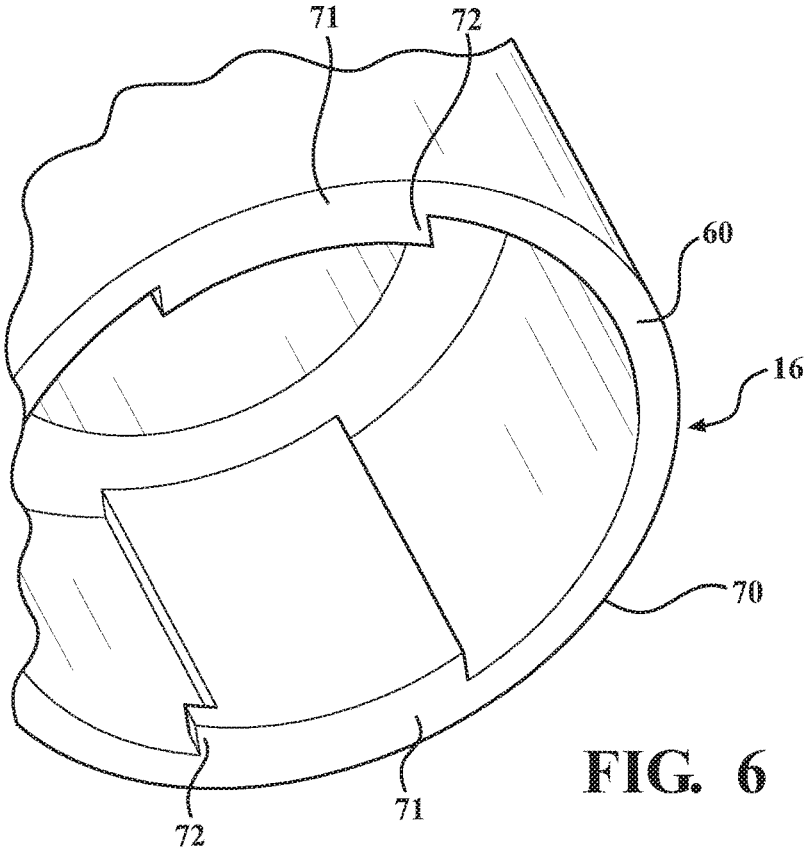
FIG. 6 is a bottom perspective view of the drive end of the socket.

As noted above, a suitable socket tool 16 is provided which can engage the drive collar 49 of the jamb nut 17 for screwing spark plug 10 into and out of the engine head 12. Referring to FIGS. 3, 5 and 6, the socket 16 preferably is formed with a cylindrical socket wall or body 60 that is sized to fit into the upper bore chamber 11A. The upper end of the socket wall 60 includes a drive pocket 61 (see FIG. 3) that is configured to releasably engage with a drive lug of a socket driver such as a socket wrench (not shown). The lower end of the socket wall 60 is formed as a cylindrical socket mouth 70 having a drive wall formed with a plurality of drive teeth 71, which are shaped to fit within the drive slots 51 provided in the jamb nut 17. The drive teeth 71 preferably are formed on diametrically opposite sides of the socket mouth 70 in alignment with the drive slots 51 so that the drive teeth 71 can slide axially into engagement with the drive slots 51. When mutually engaged as seen in FIG. 5, rotation of the socket 16 by suitable socket driver (not shown) will cause rotation of the jam nut 17. As such, the spark plug 10 can be screwed into or out of the plug hole 11 by the socket 16.

The drive slots 51 are circumferentially larger than the drive teeth 71 such that socket 16 is able to rotate a small amount relative to the drive collar 49 until the opposing side edges of the drive teeth 71 and drive slots 51 abut circumferentially against each other during socket driving. Since the drive teeth 71 define a relatively large surface area, the opposed side edges of the drive teeth 71 and drive slots 51 are able to circumferentially abut against each other and distribute rotational circumferential forces over a relatively large surface area to resist damage during spark plug removal and installation.

To further assist in removal of the spark plug 10 by the socket 16, the socket mouth 70 is also formed with a circumferential socket catch 72 on one side of each drive tooth 71 at the open end of the socket mouth 70. The socket catch 72 is able to hook under the collar shoulder 52 during socket rotation as seen in FIG. 5 so that the socket 16 hooks onto the collar shoulder 52 and serves to pull the spark plug 10 outwardly during plug removal, wherein the jamb nut 17 and insulator 19 are pulled axially together by the socket 16. Notably, the circumferential width of the socket tooth 71 and its associated socket catch 72 are proximate to but less than the circumferential width of the respective slot 51 so that the socket tooth 71 can slid axially through the slot 51 and then the socket catch 72 displaces circumferentially underneath the collar shoulder 52 by small rotation of the socket 16 relative to the jamb nut 17.

When spark plug 10 is threaded into the engine bore or plug hole 11, insulator 19 provides a compressive force that transmits a mechanical connection between drive rim 47 and the upper shoulder 42 of the shell 40, while the lower shoulder 41 of the shell 40 is driven axially into sealing engagement with the frustoconical shoulder 43 of the plug hole 11. By the mechanical contact between the shell 40, ground shield 20 and plug hole 11, an electrical ground connection is formed between ground shield 20 and the engine head 12 while at the same time sealing the combustion chamber 14 from the surrounding environment.

Since the jamb nut 17 can rotate relative to the remaining components of the spark plug 10, rotation of the jamb nut 17 displaces the jam nut 17 axially which in turn displaces the remaining components of the spark plug 10 into and out of the plug hole 11. Notably, the remaining plug components need not rotate during plug installation and removal. Therefore, as one aspect of the present invention, this inventive construction provides an improved high thread jamb nut 17 with a retaining clip 55 that allows improved driving of the jamb nut 17 by a socket 16 or other suitable tool.

As a second aspect of the present invention, the invention also relates to an improved ground shield construction that provides for precise ground strap orientation once the spark plug 10 is mounted in the engine head 12. In the spark plug 10, the insulator 19 preferably is cylindrical and has an axisymmetric shape along the central plug axis 75 (FIG. 3). Similarly, the shell 40 and jamb nut 17 also are axisymmetric relative to the central plug axis 75. However, referring to FIGS. 7-9, the plug hole 11 preferably is formed within a non-axisymmetric shape that corresponds closely to the geometric shape of the ground shield 20, which also is non-axisymmetric and thereby serves to define a precise or predefined orientation for the ground strap 36 relative to the ports 15 of the engine head 12. Preferably, the non-axisymmetric geometric shape of the ground shield 20 and bore hole 11 limits installation of the spark plug 10 to a single orientation when mounted in the plug hole 11. As seen in more detail in FIGS. 8 and 9, the ground strap 36 extends transverse across the spark plug 10 and is installed in the single predefined orientation in the combustion chamber 14.

Figure 10:
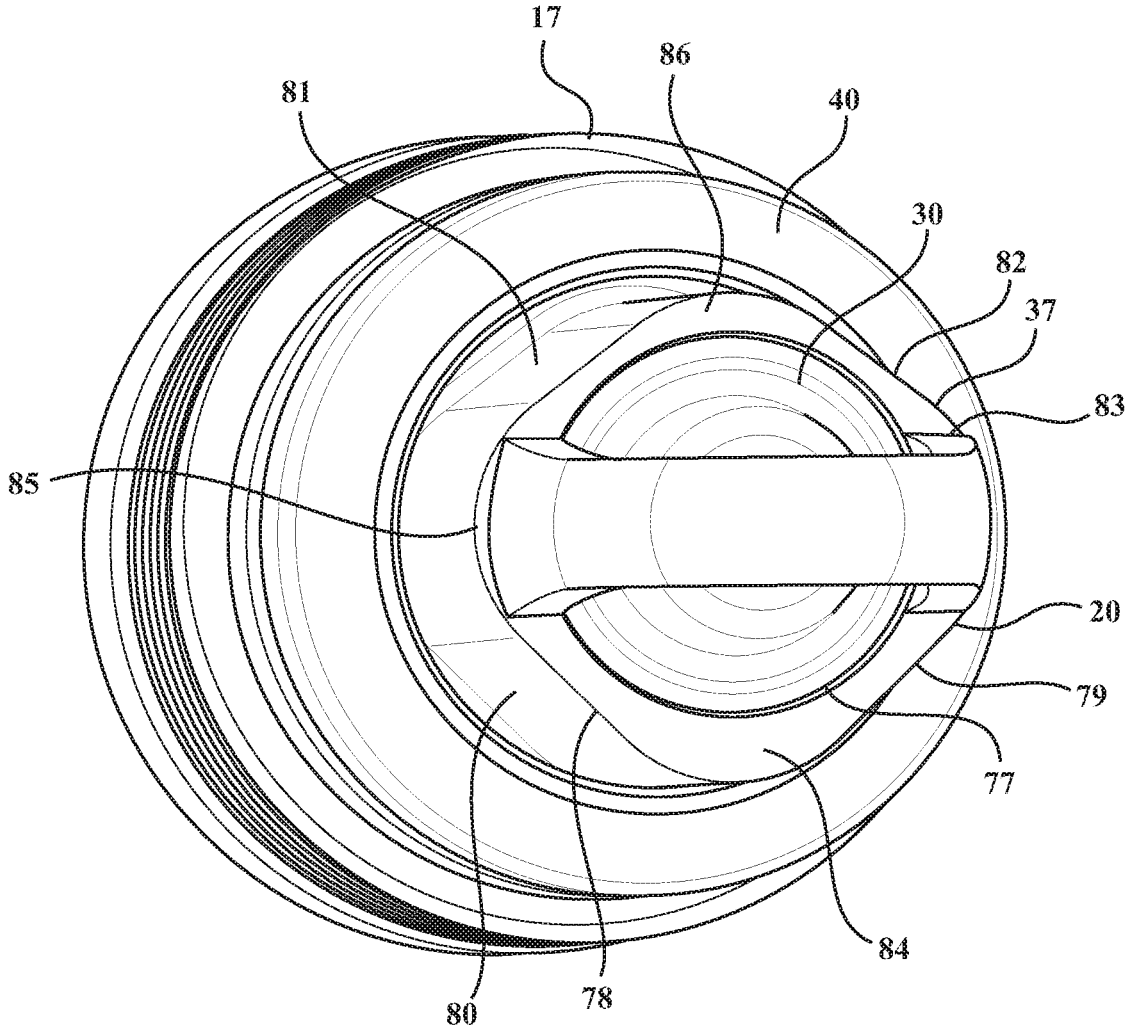
FIG. 10 is an end perspective view of the spark plug with a ground shield in a first ground shield embodiment.
Figure 11A:
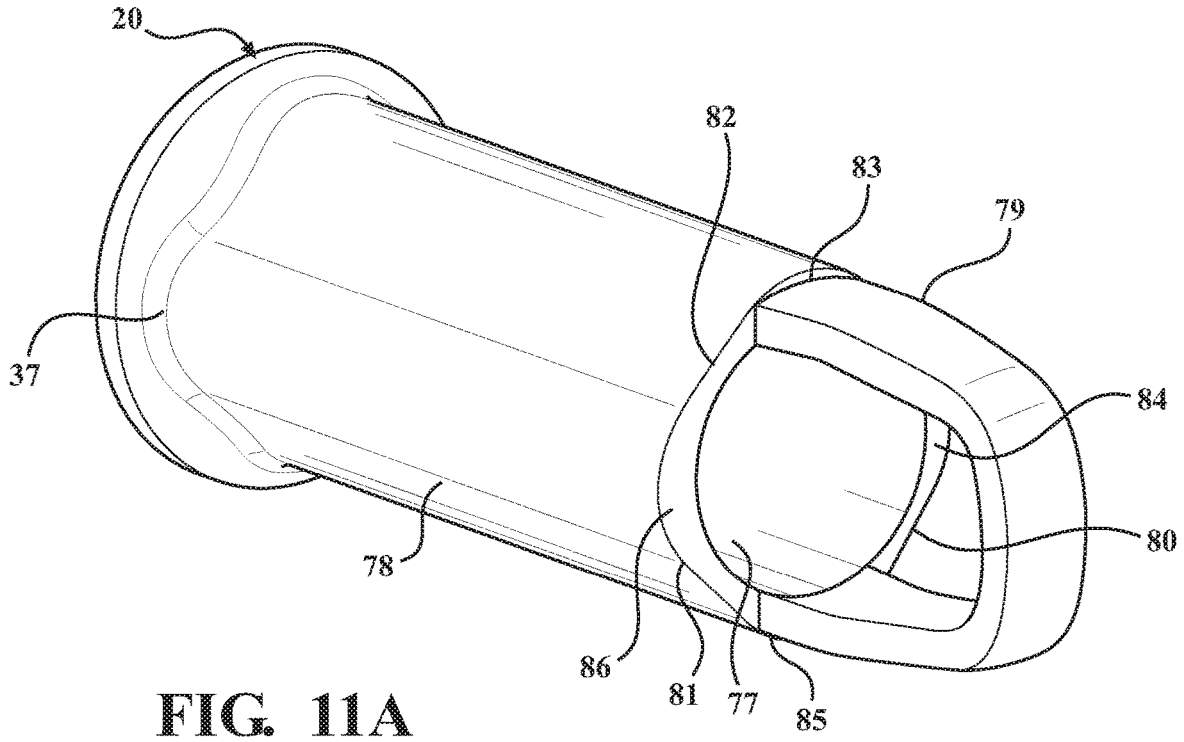
FIG. 11A is a side perspective view of the ground shield of FIG. 10 separate from the remaining components of the spark plug.
Figure 11B:
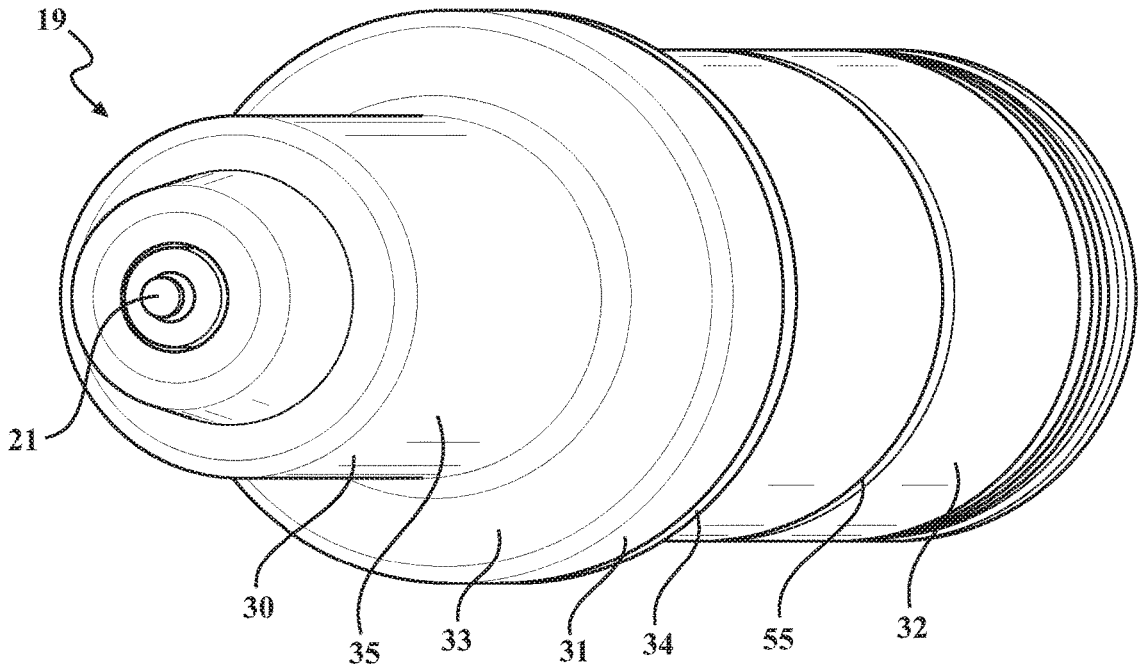
FIG. 11B is a perspective view of the insulator of FIG. 10 separate from the remaining components of the spark plug.

Referring in more detail to FIGS. 10, 11A and 11B, the ground shield 20 includes the generally U-shaped ground electrode strap 36 that diametrically spans the base portion 37. The base portion 37 includes an interior shield surface 77 that concentrically surrounds the outer surface 35 of the first insulator section 30. Preferably, the outer surface 35 of the first insulator section 30 is cylindrical or uniformly circular in cross-section as shown in FIG. 11B. The base portion 37 also includes a non-axisymmetric outer surface 78, which differs from the shape of the interior shield surface 77. The outer shield surface 78 extends axially and supports the ground strap 36 at the free end thereof. Generally, the outer shield surface 78 is formed by four sides or side section 79, 80, 81 and 82, which are joined by arcuate corners or corner sections 83, 84, 85 and 86. Two of the corner sections 83 and 85 preferably support the opposite ends of the ground strap 36.

Figure 7:
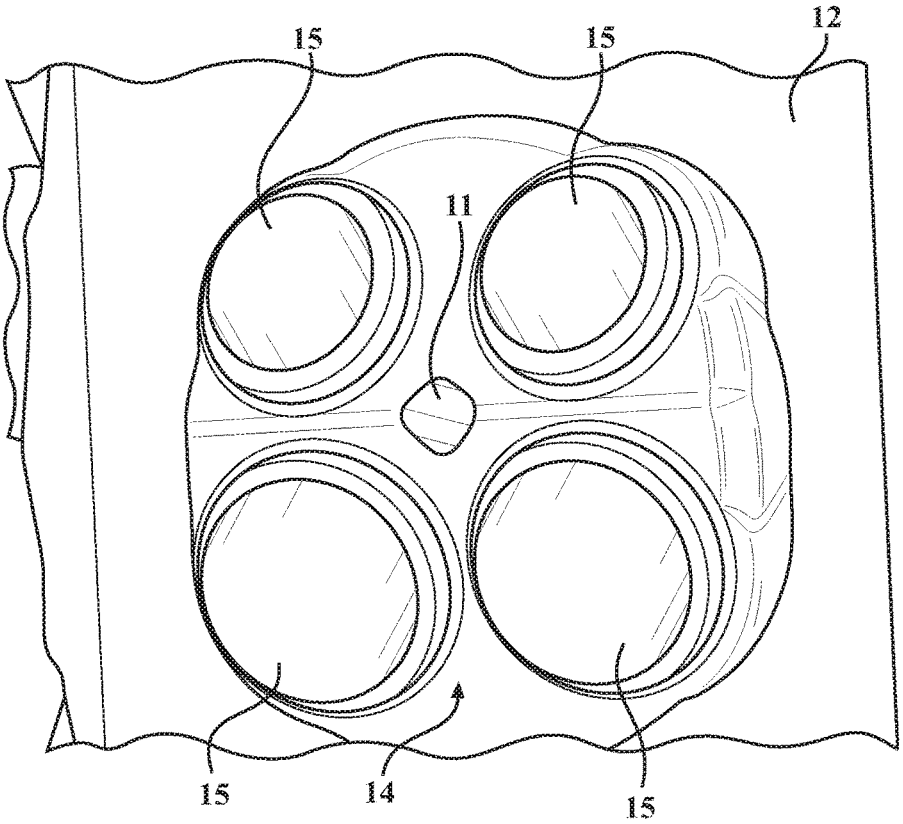
FIG. 7 is an interior perspective view of the engine head as viewed from a combustion chamber.
Figure 8:
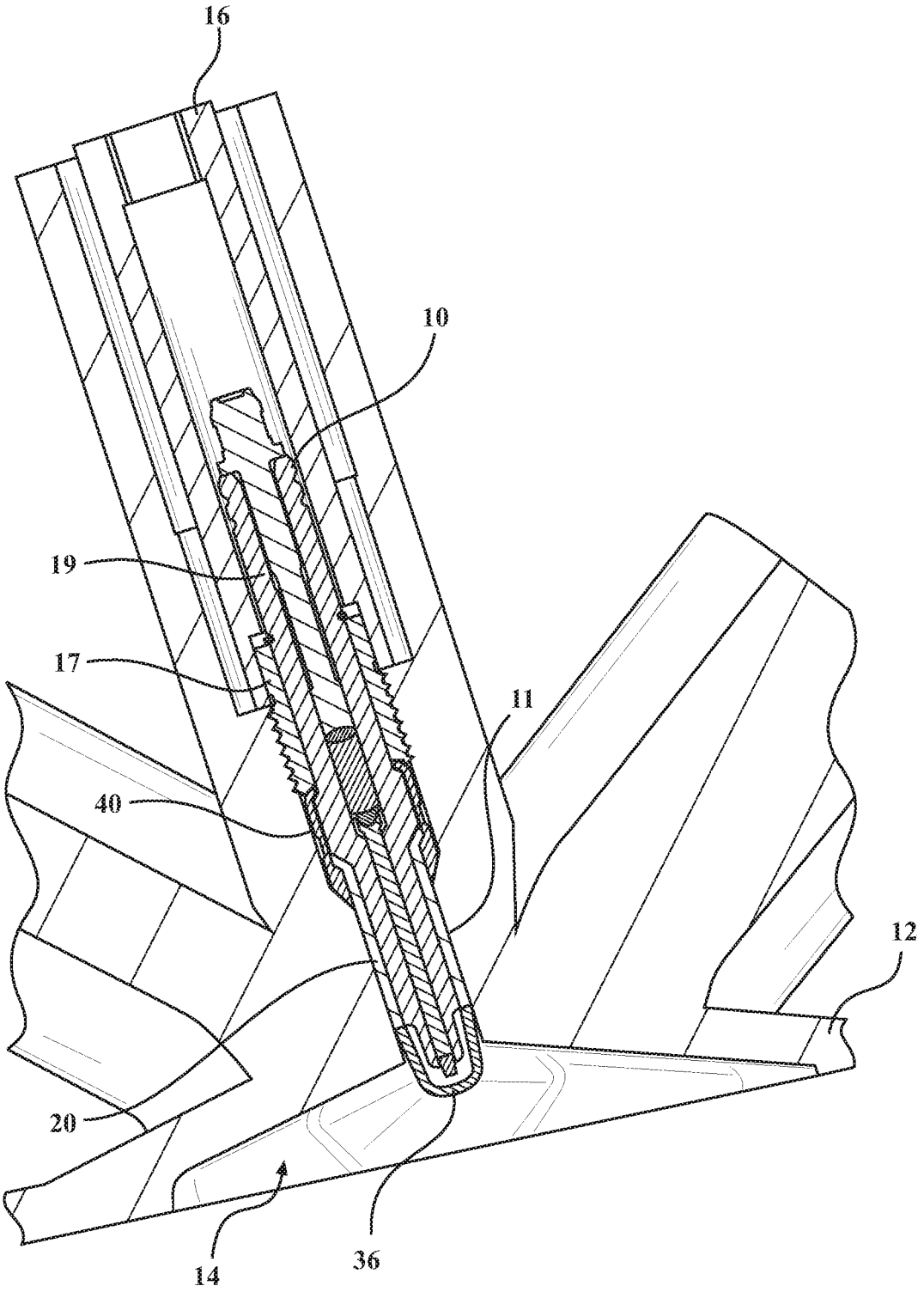
FIG. 8 is a cross sectional view of the spark plug mounted in the engine head as viewed from a first side angle.
Figure 9:
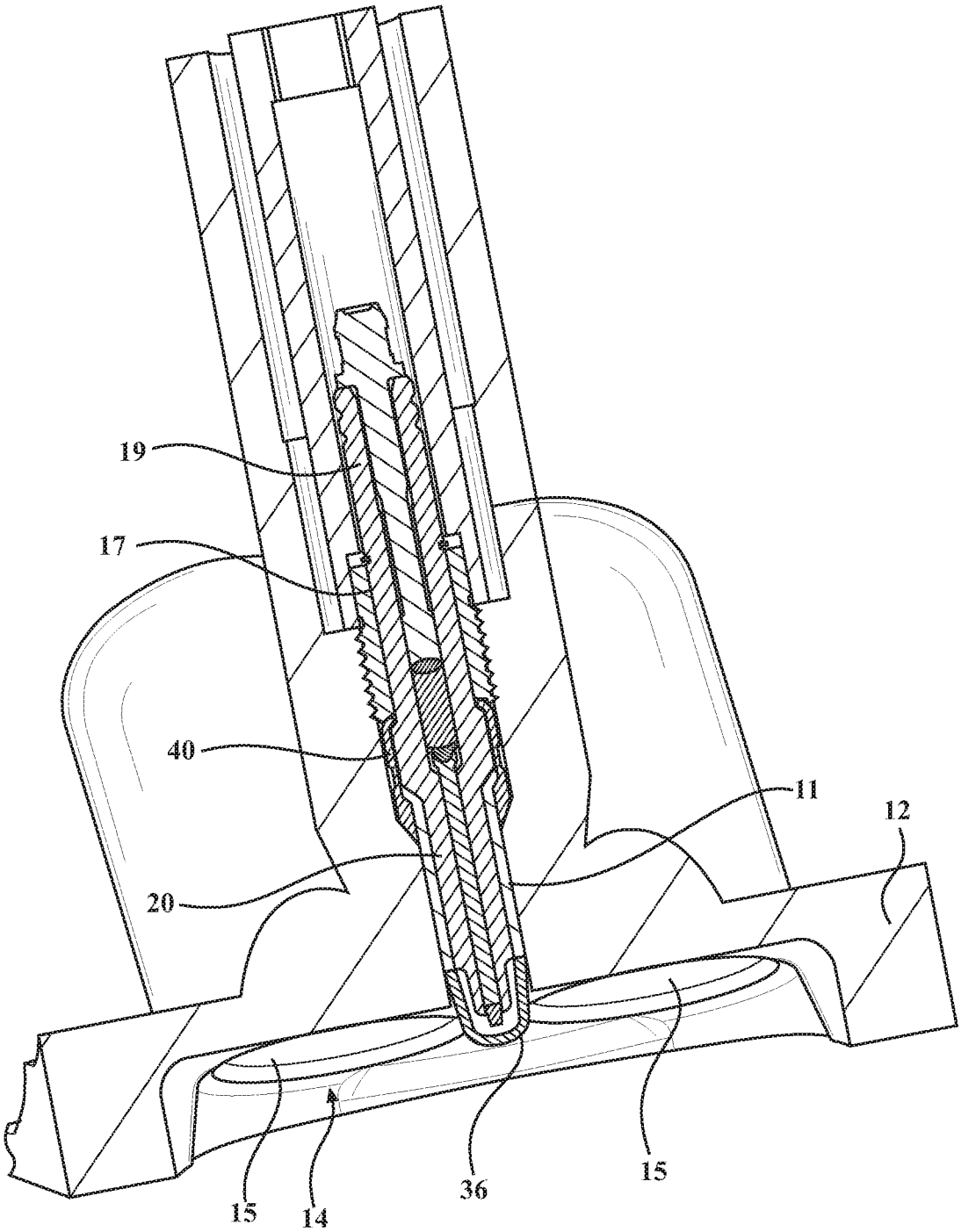
FIG. 9 is a cross sectional view of the spark plug mounted in the engine head as viewed from a second side angle.

In this configuration, at least two and preferably three of the corner sections 83, 84 and 85 have a radial thickness that are similar. The intermediate side sections 79 and 80 are shaped similar to each other with a similar radial thickness. However, the fourth corner section 86 is radially thinner than the remaining corner sections 83-85 so that the remaining side sections 81 and 82 thin radially as they progress from the thicker corner sections 83 and 85 to the thinner corner section 86 disposed therebetween. As a result, the ground shield 20 is formed with a non-axisymmetric shape relative to the transverse axis extending transverse to the ground strap 36. The plug hole 11 also has a corresponding non-axisymmetric shape as seen in FIG. 7, which allows the ground shield 20 to slide axially into the plug hole 11 only when the two complementary, non-axisymmetric shapes of the plug hole 11 and ground shield 20 are aligned with each other. This shape restricts installation of the spark plug 10 to only a single orientation as seen in FIGS. 3 and 9. Since the jamb nut 17 is rotatable relative to the remaining plug components, the spark plug 10 can be slid axially into the plug hole 11 while the jamb nut 17 can be rotated to seat the spark plug 10 in position. During removal, the jamb nut 17 can be rotated in reverse and the spark plug 10 pulled axially out of the plug hole 11.

In this configuration, the orientation is governed by the different thicknesses of the corner sections 83-86, wherein corner sections 83-85 are thicker than remaining corner section 86. It will be understood that other configurations of the ground shield 20 may be provided to accomplish a similar result of defining a predefined, precise orientation for the spark plug 10 when installed. While one defined orientation is preferred, an engine designer might wish to provide one or more alternate, predefined orientations, which could then be governed by an alternate non-axisymmetric geometry for the ground shield 20.

As noted above, the improved construction of the jamb nut 17 allows for axial insertion and removal of the spark plug 10 from the plug hole 11, wherein the jamb nut 17 would rotate independently of the shell 40, insulator 19 and ground shield 20 for screwing and unscrewing the spark plug 10 into position. With respect to the construction of the ground shield 20, the ground shield 20 may be formed by 3D printing or casting into the above-disclosed shape. The engine head 12 may still be machined with traditional reamers and processes such as a drill press or CNC machine or even 3D printed with the hole shapes described above. The axisymmetric shell 40, jamb nut 17 and insulator 19 may still be produced using current and known production methods since the primary geometric change is in the ground shield geometry.

Figure 12:
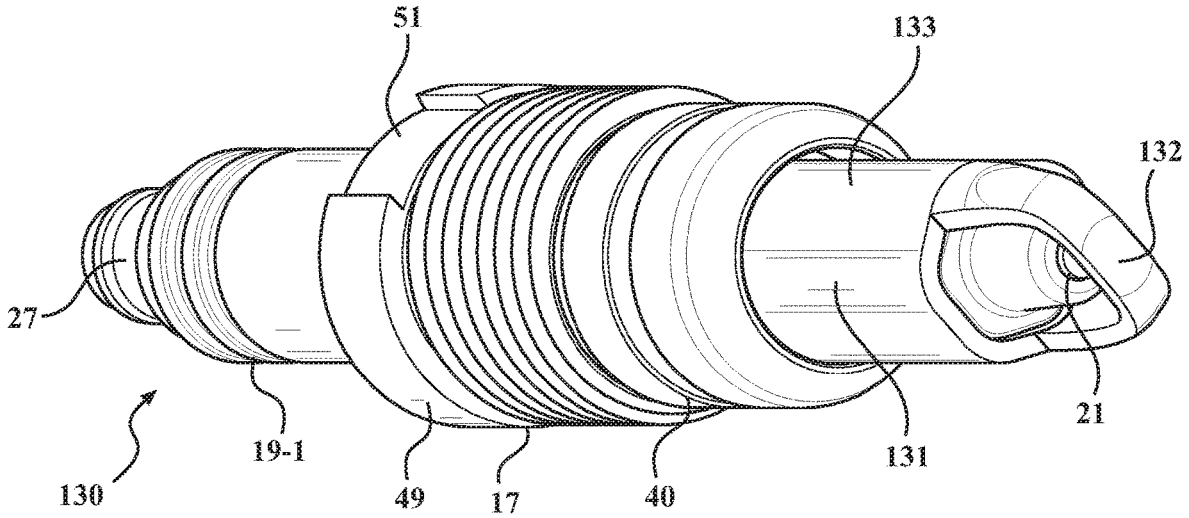
FIG. 12 is a perspective view of a spark plug in accordance with a second embodiment of the present invention.
Figure 13:
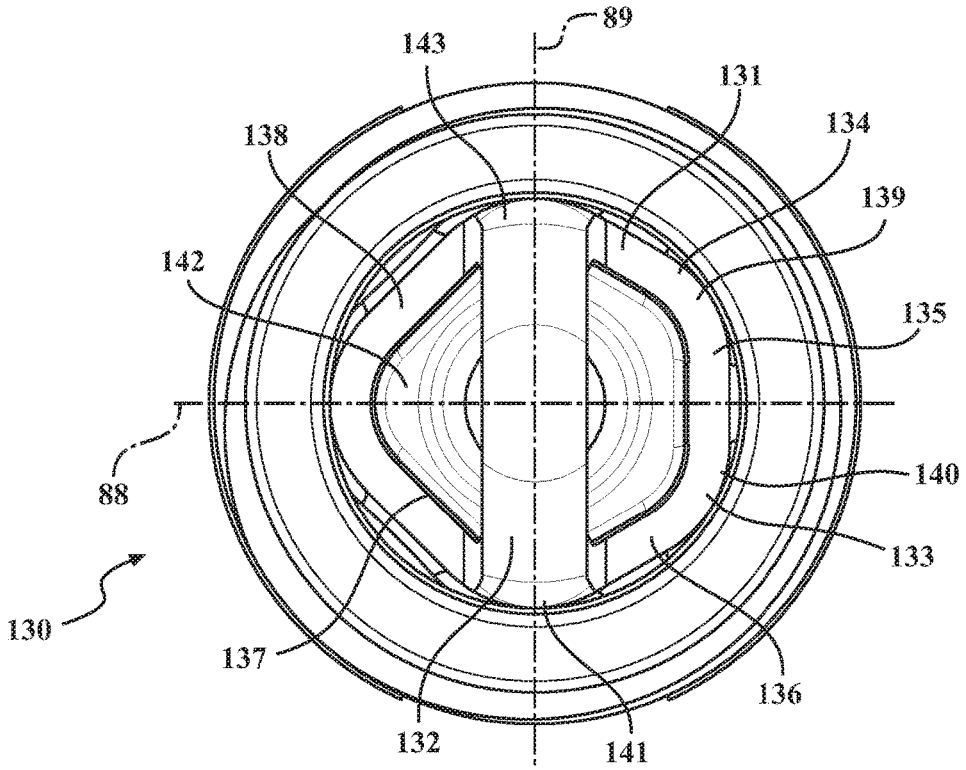
FIG. 13 is a lower end view of the spark plug of FIG. 12.
Figure 14:
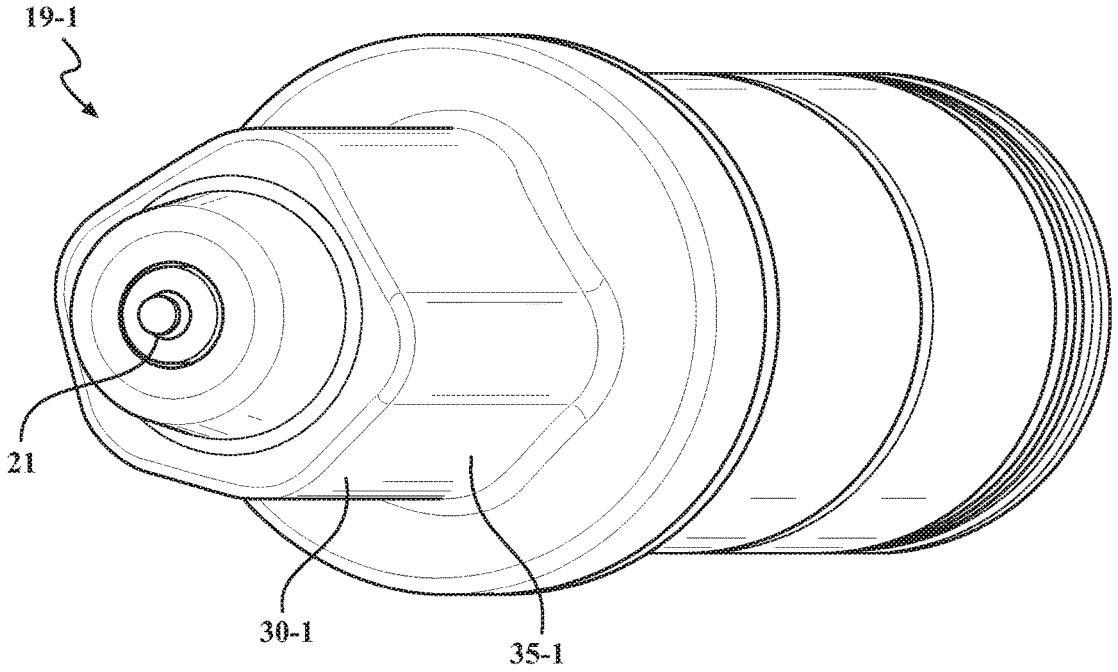
FIG. 14 is an end perspective view of the insulator in the second spark plug embodiment.

Referring to FIGS. 12 and 13, a second configuration of a spark plug 130 is shown having a modified ground shield 131, which preferably corresponds with a modified insulator 19-1 having a non-axisymmetric geometry or shape as shown in FIG. 14. Similar to ground shield 20, the ground shield 131 includes a ground strap 132 and has a non-axisymmetric outer surface 133. Generally, the outer shield surface 133 is formed by five sides or side sections 134, 135, 136, 137 and 138, which are joined by arcuate corners or corner sections 139, 140, 141, 142 and 143. Two of the corner sections 141 and 143 preferably support the opposite ends of the ground strap 132.

The side sections 134-138 and corner sections 139-143 have similar or the same radial thickness. However, the relative angles at the corner sections 139-143 generally orient the side sections 134-138 in a five-sided shape generally similar to a pentagon. The side sections 134, 135 and 136 are generally similar to each other with the corner sections 139 and 140 defining similar angles so that these three side sections 134-136 are located on one side of the plug axis 89. The other two side sections 137 and 138 and corner section 142 are located on the opposite side of the plug axis 89. As a result, the geometric shape of the ground shield 131 as seen in FIG. 13 is axisymmetric relative to plug axis 88 and non-axisymmetric relative to transverse axis 89.

The interior surface of the ground shield 131 preferably conforms to the outer surface 35-1 of the modified insulator 19-1 of FIG. 14, which has a first insulator portion 30-1 formed with the outer surface 35-1 defining a non-axisymmetric shape such that the non-axisymmetric shape of the insulator 19-1 preferably conforms to the non-axisymmetric shape of the ground shield 131 as generally seen in FIGS. 13 and 14. The outer surface 35-1 of the first insulator portion 30-1 is generally formed by five side-sections, which join together by corner sections to generally conform to the interior geometry of the ground shield 131.

Here again, the plug hole 11 also would have a corresponding non-axisymmetric shape, which allows the ground shield 131 to slide axially into the plug hole 11 only when the two complementary, non-axisymmetric shapes of the plug hole 11 and ground shield 131 are rotated into alignment with each other. In this configuration, the plug orientation is governed by the non-axisymmetric geometry of the ground shield 131 by variation of the corner angles and the chordal length of the side sections 134-136 which are shorter than the chordal length of the side sections 137 and 138. In essence, the geometric shape of the ground shield 131 has different numbers of side sections on the opposite sides of the plug axis 89. As can be seen, the jamb nut construction is usable with both insulators 19 and 19-1 having both axisymmetric and non-axisymmetric sections 30 and 30-1. While one defined orientation is preferred, an engine designer might wish to provide one or more alternate, predefined orientations, which could then be governed by an alternate non-axisymmetric geometry for the ground shield 20 or 131.

With respect to the construction of the ground shields 20 or 131, these components may be formed by 3D printing or casting into the above-disclosed shapes. The engine head 12 may still be machined with traditional reamers and processes such as a drill press or CNC machine or even 3D printed with the hole shapes described above. The axisymmetric shell 40, jamb nut 17 and insulator 19 may still be produced using current and known production methods since the primary geometric change is in the ground shield geometry. For the non-axisymmetric insulator 19-1, it may be more suitable to manufacture this component by 3D printing thereof. As noted above, the improved construction of the jamb nut 17 allows for axial insertion and removal of the spark plug from the plug hole, wherein the jamb nut 17 would rotate independently for screwing and unscrewing the spark plug into position.

Still further, it will be understood that the ground strap configuration may also be varied. As shown above, each ground strap 36 or 132 is formed as a generally U-shaped strap that completely spans the width of the respective ground shield 20 or 131. Essentially, the opposite strap ends connect at two locations on diametrically opposite sides of the respective ground shield 20 and 131. However, it will be understood that any of the ground shields 20 and 131 may be formed in any one of the alternate ground strap configurations discussed below relative to FIGS. 15-19, which may either partially or completely span the ground shield width.

Figure 15:
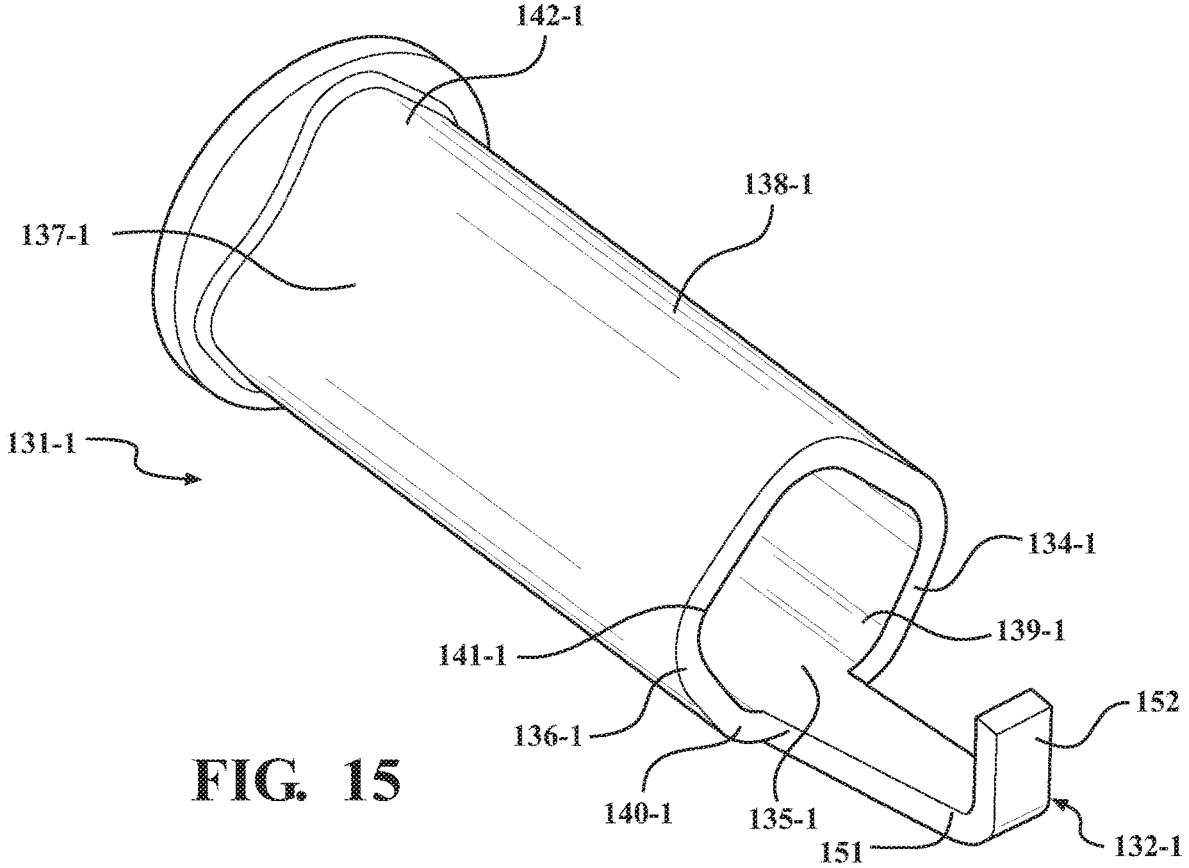
FIG. 15 is a side perspective view of the ground shield with a modified ground strap shown in a first alternate configuration thereof.

For reference purposes, FIG. 15 illustrates a five-sided ground shield 131 modified to include a first alternate ground strap 132-1 and thereby form a first alternate ground shield 131-1. FIGS. 16-19 disclose additional alternate grounds strap configurations, which are designated by common reference numerals with a unique suffix for each embodiment.

In more detail, FIG. 15 is a side perspective view of the ground shield 131-1 similar to the ground shield 131 shown in FIGS. 12 and 13. The ground shield 131-1 uses the same geometry as ground shield 131 so as to be formed by five sides or side sections 134-1, 135-1, 136-1, 137-1 and 138-1, which are joined by arcuate corners or corner sections 139-1, 140-1, 141-1, 142-1 and 143-1. In FIG. 13 discussed above, two of the corner sections 141 and 143 preferably support the opposite ends of the U-shaped ground strap 132. However, in FIG. 15, the first alternate ground strap 132-1 has one connector leg 151 connected at one location to the side section 135-1 to partially span the ground shield width. The connector leg 151 has an electrode leg 152 oriented transverse to the connector leg 151 to centrally overlie the electrode tip (see above) in axially spaced relation and form a spark plug gap therebetween when the ground shield 131-1 is mounted on the insulator 19-1 in accord with the above discussion.

Figure 16:
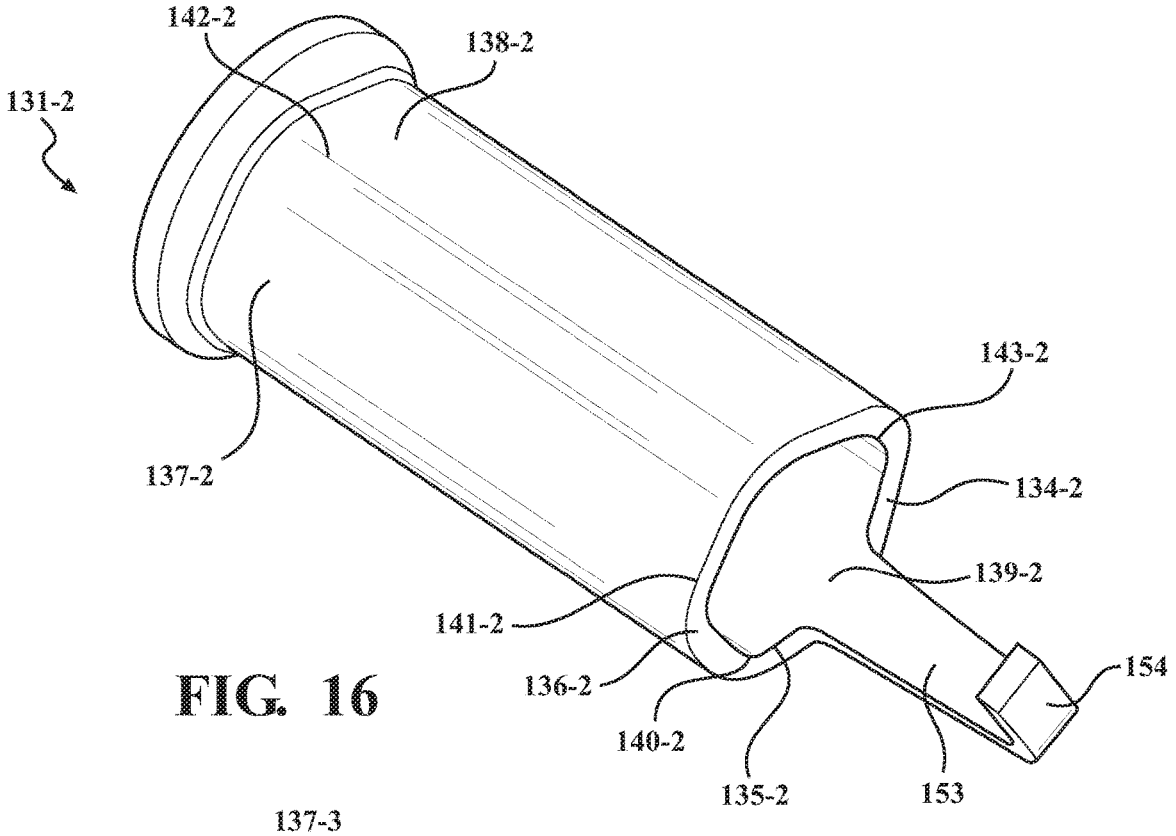
FIG. 16 is a side perspective view of the ground shield with the ground strap shown in a second alternate configuration thereof.

In a second alternate strap configuration, the ground shield 131-2 of FIG. 16 has the ground shield 131-2 formed by five sides or side sections 134-2, 135-2, 136-2, 137-2 and 138-2, which are joined by arcuate corners or corner sections 139-2, 140-2, 141-2, 142-2 and 143-2. As a modification to FIG. 15, the second alternate ground strap 132-2 also connects at one location wherein the connector leg 153 connects to the corner section 139-2 and includes an electrode leg 154 which extends transverse from the connector leg 153 to partially span the ground shield width. As such, the electrode leg 154 overlies the electrode tip (see above) in axially spaced relation to form a spark plug gap therebetween when the ground shield 131-2 is mounted on the insulator 19-1 in accord with the above discussion. This allows the location or orientation of the electrode leg or section 154 to be varied without changing the orientation of the spark plug when installed in the plug hole as defined by the ground shield geometry.

Figure 17:
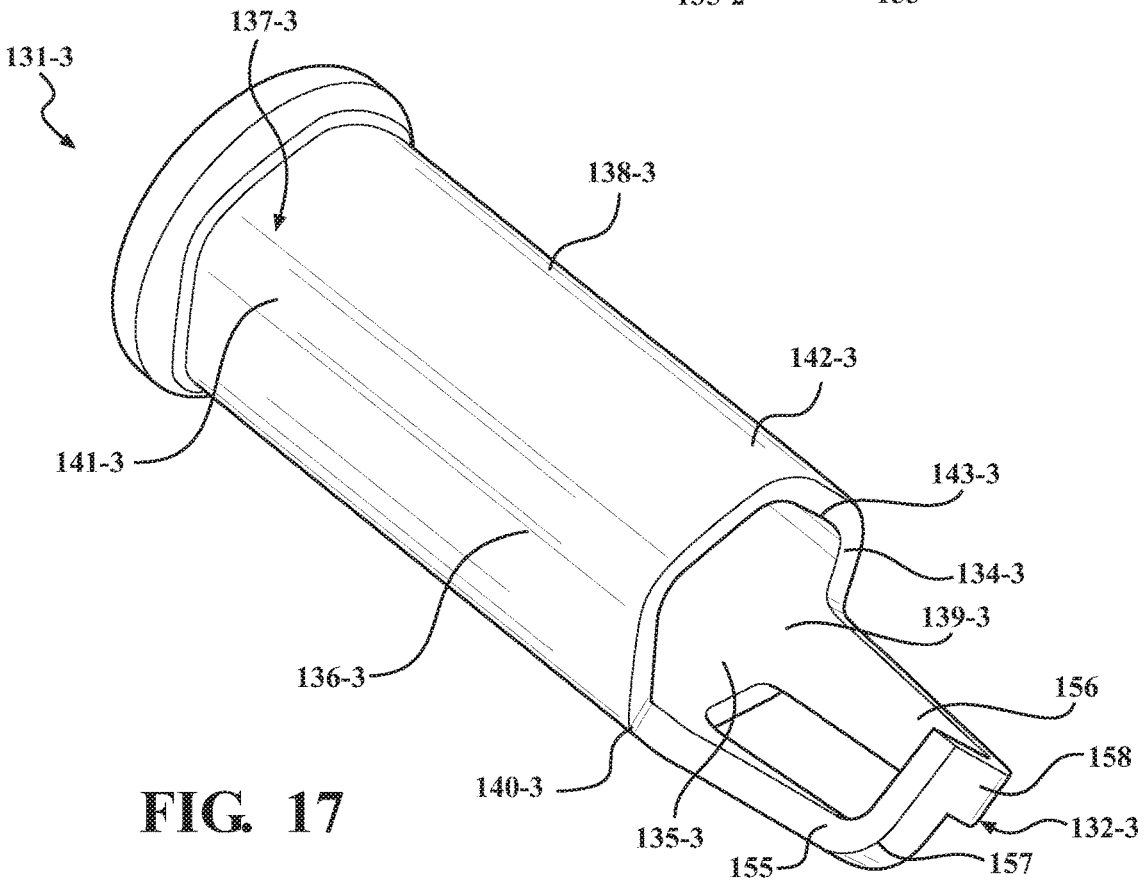
FIG. 17 is a side perspective view of the ground shield with the ground strap shown in a third alternate configuration thereof.

In a third alternate strap configuration, the ground shield 131-3 of FIG. 17 has the ground shield 131-3 formed by five sides or side sections 134-3, 135-3, 136-3, 137-3 and 138-3, which are joined by arcuate corners or corner sections 139-3, 140-3, 141-3, 142-3 and 143-3. The third alternate ground strap 132-3 alternatively connects at two locations wherein the ground strap 132-3 includes two connector legs 155 and 156, which connect to the corner sections 139-3 and 140-3 or other locations if desired. For example, the connector legs 155 and 156 could alternatively be connected to two of the corner sections if desired. The connector legs 155 and 156 support respective electrode legs 157 and 158, which extend transverse from the connector legs 155 and 156 toward each other and join together at their ends so as to centrally overlie the electrode tip (see above) and form a spark plug gap therebetween when the ground shield 131-3 is mounted on the insulator 19-1 in accord with the above discussion.

Figure 18:
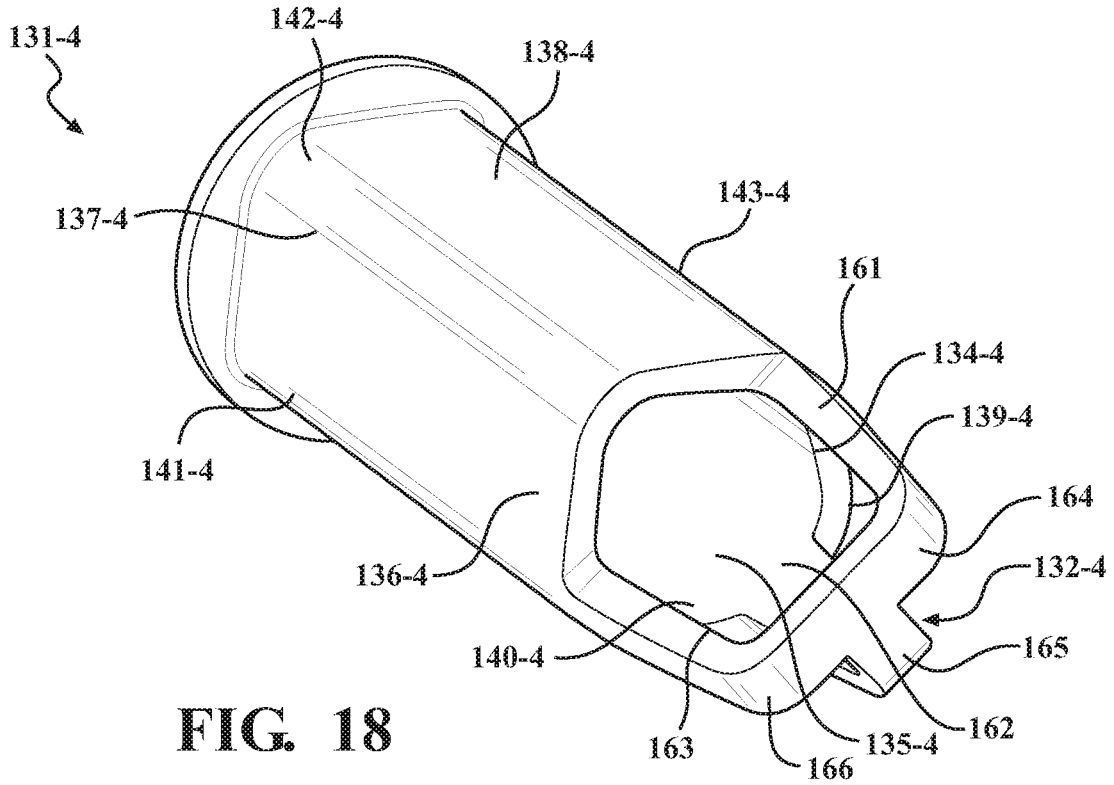
FIG. 18 is a side perspective view of the ground shield with the ground strap shown in a fourth alternate configuration thereof.

In a fourth alternate strap configuration, the ground shield 131-4 of FIG. 18 has the ground shield 131-4 formed by five sides or side sections 134-4, 135-4, 136-4, 137-4 and 138-4, which are joined by arcuate corners or corner sections 139-4, 140-4, 141-4, 142-4 and 143-4. The fourth alternate ground strap 132-4 alternatively connects at three locations wherein the ground strap 132-4 includes three connector legs 161, 162 and 163, which connect to the corner sections 140-4 and 143-4 and the side section 135-4 or other locations if desired. The connector legs 161, 162 and 163 support respective electrode legs 164, 165 and 166, which extend transverse from the connector legs 161, 162 and 163 and join together at their ends so as to centrally overlie the electrode tip (see above) and form a spark plug gap therebetween when the ground shield 131-4 is mounted on the insulator 19-1 in accord with the above discussion.

Figure 19:
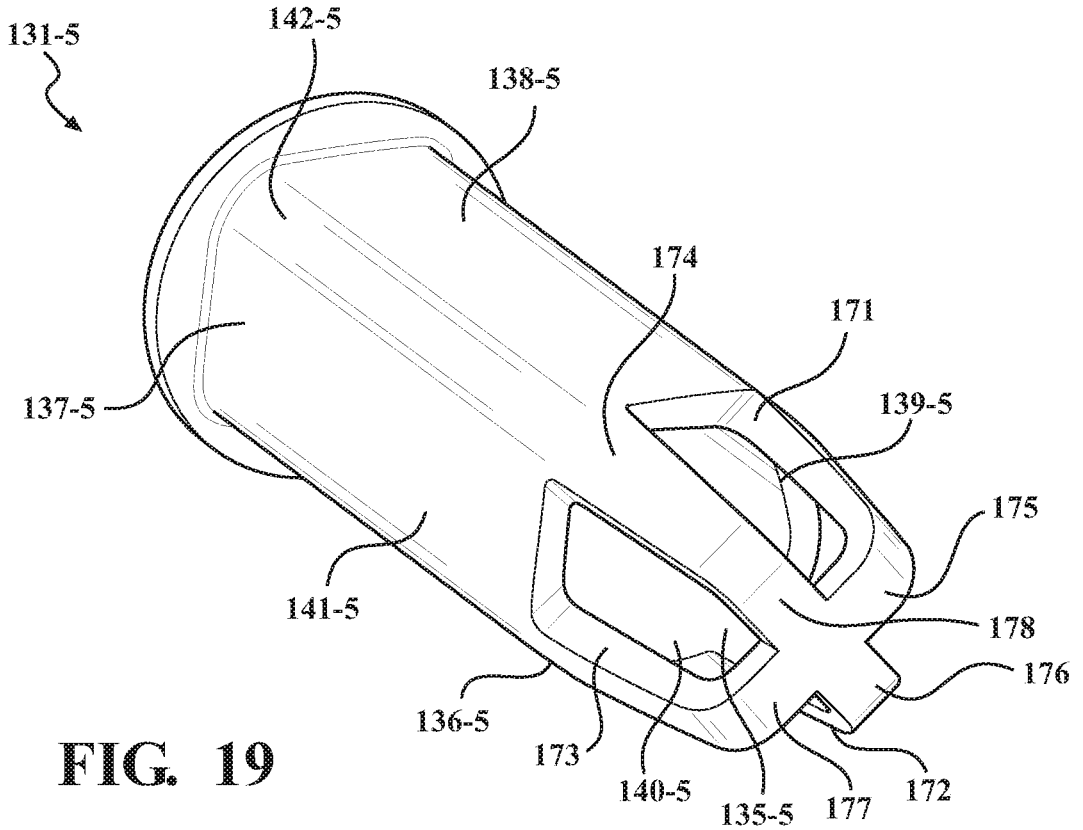
FIG. 19 is a side perspective view of the ground shield with the ground strap shown in a fifth alternate configuration thereof.

In a fifth alternate strap configuration, the ground shield 131-5 of FIG. 19 has the ground shield 131-5 formed by five sides or side sections 134-5, 135-5, 136-5, 137-5 and 138-5, which are joined by arcuate corners or corner sections 139-5, 140-5, 141-5, 142-5 and 143-5. The fifth alternate ground strap 132-5 alternatively connects at four locations wherein the ground strap 132-5 includes four connector legs 171, 172, 173 and 174, which preferably connect to the corner sections 140-5, 142-5 and 143-5 and the side section 135-5 or other locations if desired. The connector legs 171, 172, 173 and 174 support respective electrode legs 175, 176, 177 and 178, which extend transverse from the connector legs 171, 172, 173 and 174 and join together at their ends so as to centrally overlie the electrode tip (see above) and form a spark plug gap therebetween when the ground shield 131-5 is mounted on the insulator 19-1 in accord with the above discussion.

This inventive arrangement provides for an improved spark plug having the jamb nut held axially on the insulator by the retaining clip to prevent the jamb nut from backing out and separating from the remaining plug components during removal. Further, the jamb nut distributes torque from the tool over an increased surface area during installation and removal, and includes a catch so that the tool is usable to help remove the spark plug from the plug hole. Further, these different ground shield configurations provide for high thread spark plugs having non-axisymmetric ground shields that define precise, predefined ground strap orientations. This design provides engine designers with increased precision control over how the ground strap will be oriented in the combustion chamber, which should result in more stable combustion at extreme operating conditions as found in modern engines.

Although a particular preferred embodiment of the invention has been disclosed in detail for illustrative purposes, it will be recognized that variations or modifications of the disclosed apparatus, including the rearrangement of parts, lie within the scope of the present invention.

What is claimed:

1. A spark plug for an internal combustion engine, the spark plug comprising: an elongated center electrode having a center electrode tip at a first end and a terminal proximate a second, opposite end; an insulator substantially surrounding the center electrode; a ground shield surrounding a portion of the insulator proximate said center electrode tip in spaced relation to define a spark gap therebetween, a shell substantially surrounding the insulator and defining a drive shoulder at one end and a seating shoulder at an opposite end proximate said ground shield for seating engagement with a spark plug hole of an engine head; a jamb nut rotatably supported on said insulator axially outwardly of said drive shoulder, said jamb nut having a first end portion comprising a threaded portion proximate said shell for threaded engagement with said plug hole, said jamb nut being rotatable relative to said insulator and said first end portion terminating at a drive rim which axially contacts said drive shoulder of said shell to axially drive said spark plug into said plug hole, said jamb nut having a second end portion opposite said first end portion which includes a drive collar for rotatable driving by a tool; and a retaining member fixed on said insulator adjacent said second end portion of said jamb nut to prevent axial separation of said jamb nut from said insulator during spark plug removal from said plug hole.

2. The spark plug according to claim 1, wherein said jamb nut is rotatable relative to said shell.

3. The spark plug according to claim 2, wherein said shell is axially fixed to an intermediate portion of said insulator for axial movement with said insulator during spark plug removal and installation.

4. The spark plug according to claim 1, wherein said insulator includes a groove and said retaining member comprises a retaining clip axially fixed within said groove so as to prevent axial outward movement of said jamb nut relative to said insulator.

5. The spark plug according to claim 4, wherein said jamb nut is rotatable relative to said retaining clip but axially restrained by said retaining clip.

6. The spark plug according to claim 4, wherein said drive collar includes one or more drive formations engageable with the tool to effect rotation of said jamb nut by said tool.

7. The spark plug according to claim 6, wherein said drive formations extend axially over an axial length to define circumferentially spaced apart side edges to accommodate torque transferred thereto from said tool.

8. The spark plug according to claim 7, wherein said one or more drive formations each comprise an axial slot with said side edges extending axially along said axial length of said slot and facing circumferentially for abutment against opposing surfaces of said tool.

9. The spark plug according to claim 8, wherein said drive collar defines an inward facing collar shoulder which is hookable by said tool to facilitate pulling of said spark plug from said plug hole.

10. The spark plug according to claim 7, wherein said spark plug is provided in combination with said tool for mechanically rotating said spark plug, said tool including an end socket having drive formations complementary to and engagable with drive formations of said drive collar to transfer rotative torque from said socket to said drive collar.

11. The spark plug according to claim 10, wherein said drive collar defines an inward facing collar shoulder, and said socket includes a catch extending circumferentially to hook under said collar shoulder to prevent axial separation of said tool from said jamb nut when engaged therewith.

12. A spark plug for an internal combustion engine, the spark plug comprising: an elongated center electrode having a center electrode tip at a first end and a terminal proximate a second, opposite end; an insulator substantially surrounding the center electrode and defining an enlarged intermediate section defined by first and second insulator shoulders; a ground shield surrounding a portion of the insulator proximate said center electrode tip in spaced relation to define a spark gap therebetween, a shell substantially surrounding the insulator and defining a drive shoulder at one end and a seating shoulder at an opposite end proximate said ground shield for seating engagement with a spark plug hole of an engine head, said drive shoulder and said seating shoulder abutting against said first and second insulator shoulders to prevent axial displacement of said shell along said insulator; a jamb nut rotatably supported on said insulator axially outwardly of said drive shoulder, said jamb nut having a first end portion comprising a threaded portion proximate said shell for threaded engagement with said plug hole where reversing rotation of said jamb nut moves said spark plug into and out of said plug hole, said jamb nut being rotatable relative to said insulator and said shell, and said first end portion terminating at a drive rim which axially contacts said drive shoulder of said shell to axially drive said spark plug into said plug hole during rotation of said jamb nut in a first rotation direction during spark plug installation, said jamb nut having a second end portion opposite said first end portion which includes a drive collar for rotatable driving by a tool in said first rotation direction and an opposite second rotation direction; and a retaining member fixed on said insulator adjacent said second end portion of said jamb nut to prevent axial separation of said jamb nut from said insulator during rotation of said jamb nut in said second rotation direction during spark plug removal.

13. The spark plug according to claim 12, wherein said insulator includes a groove and said retaining member comprises a retaining clip axially fixed within said groove so as to prevent axial outward movement of said jamb nut relative to said insulator.

14. The spark plug according to claim 13, wherein said jamb nut is rotatable relative to said retaining clip but axially restrained by said retaining clip.

15. The spark plug according to claim 12, wherein said drive collar includes one or more drive formations engagable with a tool to effect rotation of said jamb nut by said tool.

16. The spark plug according to claim 15, wherein said drive formations extend axially over an axial length to define circumferentially spaced apart side edges to accommodate torque transferred thereto from said tool.

17. The spark plug according to claim 16, wherein said one or more drive formations each comprise an axial slot with said side edges extending axially along said axial length of said slot and facing circumferentially for abutment against opposing surfaces of said tool.

18. The spark plug according to claim 17, wherein said drive collar defines an inward facing collar shoulder, which is hookable by said tool to facilitate pulling of said spark plug from said plug hole.

19. The spark plug according to claim 12, wherein said spark plug is provided in combination with a tool for mechanically rotating said spark plug, said tool including an end socket having drive formations complementary to and engagable with drive formations of said drive collar to transfer rotative torque from said socket to said drive collar.

20. The spark plug according to claim 19, wherein said drive collar defines an inward facing collar shoulder, and said socket includes a catch extending circumferentially to hook under said collar shoulder to prevent axial separation of said tool from said jamb nut when engaged therewith.

* * * * *